US008662144B2

(12) United States Patent
Williamson et al.

(10) Patent No.: US 8,662,144 B2
(45) Date of Patent: Mar. 4, 2014

(54) METHODS OF CASTING SCROLL COMPRESSOR COMPONENTS

(71) Applicants: Warren G. Williamson, Sidney, OH (US); Scott S. Hendrie, Coldwater, MI (US)

(72) Inventors: Warren G. Williamson, Sidney, OH (US); Scott S. Hendrie, Coldwater, MI (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 13/633,262

(22) Filed: Oct. 2, 2012

(65) Prior Publication Data

US 2013/0087299 A1 Apr. 11, 2013

Related U.S. Application Data

(60) Provisional application No. 61/542,566, filed on Oct. 3, 2011.

(51) Int. Cl.

| | |
|---|---|
| ***B22D 25/02*** | (2006.01) |
| ***B22D 33/04*** | (2006.01) |
| ***B22C 9/02*** | (2006.01) |
| ***B22C 9/08*** | (2006.01) |

(52) U.S. Cl.
USPC ..... 164/133; 164/137; 164/339

(58) Field of Classification Search
USPC ..... 164/133, 137, 339
See application file for complete search history.

(56) References Cited

U.S. PATENT DOCUMENTS

| | | | |
|---|---|---|---|
| 728,011 | A | 5/1903 | Reed |
| 1,003,709 | A | 9/1911 | Cordingly |
| 1,502,861 | A | 7/1924 | Meloche |
| 2,150,510 | A | 3/1939 | Jeune |
| 2,268,676 | A | 1/1942 | Shanley |
| 2,919,479 | A | 1/1960 | Menningen |
| 3,554,271 | A | 1/1971 | Goss |
| 3,897,817 | A | 8/1975 | Nieman |
| 3,971,433 | A | 7/1976 | Duchenne |

(Continued)

FOREIGN PATENT DOCUMENTS

| | | |
|---|---|---|
| DE | 922299 | 1/1955 |
| JP | 56-26657 | 3/1981 |

(Continued)

OTHER PUBLICATIONS

American Society for Metals, "Metals Handbook, Desk Edition," Chapter 5 (1985).

*Primary Examiner* — Kevin P Kerns
*Assistant Examiner* — Jacky Yuen
(74) *Attorney, Agent, or Firm* — Harness, Dickey & Pierce, P.L.C.

(57) ABSTRACT

Methods of casting improved scroll compressor components having high quality involute portions are provided. The casting method comprises gating molten metal through a patterned region of a core or mold defining the involute vanes. In certain aspects, during casting, molten metal passes through one or more gates that extend through a core in a central patterned region that forms the involute portion of the scroll component. In certain variations, the metal comprises a gray cast iron, so the cast part comprises an involute having a matrix of pearlite and Type A graphite that is substantially free of undercooling defects. Further, in certain variations, the involute portion is substantially free of Types B-E graphite. Thus, high-quality low-defect cast scroll components are formed having good machinability and superior fatigue strength.

20 Claims, 9 Drawing Sheets

(56) References Cited

U.S. PATENT DOCUMENTS

| | | | | | |
|---|---|---|---|---|---|
| 4,154,289 | A | | 5/1979 | Jeanneret | |
| 4,352,390 | A | | 10/1982 | Larson | |
| 4,456,051 | A | | 6/1984 | Hukuhara | |
| 4,742,863 | A | | 5/1988 | Witt | |
| 4,913,218 | A | | 4/1990 | Seidinger | |
| 5,033,531 | A | | 7/1991 | Fisher | |
| 5,201,811 | A | | 4/1993 | Lebold | |
| 5,263,533 | A | * | 11/1993 | Druschitz et al. | 164/363 |
| 5,390,723 | A | | 2/1995 | Mohla et al. | |
| 5,526,868 | A | | 6/1996 | Campbell | |
| 5,580,401 | A | * | 12/1996 | Williamson | 148/321 |
| 5,743,321 | A | | 4/1998 | Joern | |
| 5,887,646 | A | | 3/1999 | Evans | |
| RE37,520 | E | | 1/2002 | Williamson | |
| 6,540,005 | B1 | | 4/2003 | Daussan | |
| 6,860,315 | B2 | * | 3/2005 | Williamson | 164/133 |
| 2009/0032211 | A1 | * | 2/2009 | Hanna et al. | 164/498 |
| 2009/0242160 | A1 | * | 10/2009 | Obara et al. | 164/24 |

FOREIGN PATENT DOCUMENTS

| | | | | |
|---|---|---|---|---|
| JP | 62040966 | A | * | 2/1987 |
| JP | 4-288943 | | | 10/1992 |
| SU | 698718 | | | 12/1979 |

* cited by examiner

--Prior Art--

--Prior Art--

METHODS OF CASTING SCROLL COMPRESSOR COMPONENTS

CROSS-REFERENCE TO RELATED APPLICATIONS

This application claims the benefit of U.S. Provisional Application No. 61/542,566, filed on Oct. 3, 2011. The entire disclosure of the above application is incorporated herein by reference.

FIELD

The present disclosure relates to methods for casting scroll compressor components and solidified cast metallic scroll components made therefrom.

BACKGROUND

This section provides background information related to the present disclosure which is not necessarily prior art.

Scroll-type compressors typically include two scroll components having involute portions or vanes which are intermeshed together to define sealed pockets. One of the scroll components orbits with respect to the other scroll component, so that the pockets are progressively reduced for compression. For optimum performance, a scroll compressor design should minimize leakage, wear, and fracture. Scroll components of scroll compressors are frequently manufactured by a molten metal process ("casting"). For conventional methods of casting scroll components, a molten metal is poured into a cavity defined by a casting mold assembly, where the molten metal solidifies and forms a scroll after solidification is complete.

In casting processes, mold assemblies (including molds and optionally cores) into which the molten metal flows are frequently composed of sand, binder, and/or a ceramic coating and may not have full structural rigidity. In sand casting, generation of loose sand and other debris can occur to due high velocities and abrupt changes in direction and turbulence of the molten metal. The narrow and deep space of the involute portions or vanes of the scroll component are especially susceptible to entrapping foreign material such as loose sand that might be carried along with the molten metal. The orientation of the involute portion in the mold assembly is a factor in this susceptibility, because the long, narrow regions of the involute portion can be a trap for debris. It is desirable to minimize casting tolerances and sand-related quality problems such as scabs, inclusions and blow-holes. Furthermore, the involute portions of the scroll component are susceptible to having a temperature below a target pour temperature during casting and thus being undercooled, which has the potential to form undesirable graphite forms, defects, and/or other undesirable metal microstructures. Thus, when cast in conventional processes, the involute portions of the scroll component having such issues can have greater susceptibility to fracture or early failure.

Furthermore, in many applications, the scroll components formed from casting are subsequently extensively machined to precise tolerances. It would be desirable to minimize the extent of machining required for cast scroll components. Further, it is desirable that the scroll components formed from casting are substantially free of defects, undesirable graphite species, and/or undesirable microstructures. Casting methods are needed that can efficiently and inexpensively form high quality, low defect scroll components.

SUMMARY

This section provides a general summary of the disclosure, and is not a comprehensive disclosure of its full scope or all of its features.

In various aspects, the present disclosure provides methods for casting. For example, in certain variations, a method of casting a scroll compressor component is provided. The method optionally comprises introducing a molten metal into a casting mold assembly. The casting mold assembly comprises a mold and a core. The core has a central patterned region that defines an involute and one or more gate openings that extend through the core in the central patterned region. The mold and the core together define a cavity having a shape of a scroll compressor component comprising an involute portion, which corresponds to and is defined by, the central patterned region of the core. The molten metal is introduced to the cavity through the one or more gate openings in the involute portion of the central patterned region of the core. The method also comprises solidifying the molten metal to form a solid scroll compressor component comprising the involute portion, which is then removed from the casting mold assembly.

In other variations, methods of casting a scroll compressor component are provided that comprise introducing a molten metal comprising iron into a casting mold assembly. The casting mold assembly comprises a mold and a core. The core has a central patterned region that comprises a plurality of gate openings that extend through the core in the central patterned region. Together the mold and the core define a cavity having a shape of a scroll compressor component comprising an involute portion, which corresponds to and is defined by, the central patterned region of the core. The molten metal is introduced to the cavity through the one or more gate openings in the involute portion of the central patterned region of the core. The method further comprises solidifying the molten metal comprising iron to form a solid scroll compressor component comprising the involute portion and removing it from the casting mold assembly. The involute portion thus formed comprises a matrix of pearlite and Type A graphite, where the involute portion is substantially free of undercooling defects.

In yet other aspects, methods of forming a scroll compressor component are provided that comprise introducing a molten metal comprising iron into a casting mold assembly. The casting mold assembly comprises a mold and a core. The core has a central patterned region comprising at least nine gate openings that extend through the core in the central patterned region. Together the mold and the core define a cavity having a shape of a scroll compressor component comprising an involute portion, which corresponds to and is defined by, the central patterned region of the core. Molten metal is introduced to the cavity through the at least nine gate openings in the involute portion of the central patterned region of the core. The method also comprises solidifying the molten metal to form a solid scroll compressor component comprising the involute portion. The solid scroll compressor component is removed from the casting mold assembly, where the involute portion comprises a matrix of pearlite and Type A graphite, which is substantially free of undercooling defects. Further, the involute portion has a fatigue strength that is greater than or equal to about 18% higher than an involute portion of a comparative cast scroll compressor component cast in a comparative process where molten metal does not pass through gate openings in a central patterned region of a comparative core. In certain aspects, the method further comprises machining an involute portion of the solid scroll compressor component.

In yet other aspects, the present disclosure provides methods of casting a scroll compressor component that optionally comprise introducing a molten metal into a casting mold assembly defining a cavity having a shape of a scroll compressor component comprising an involute portion. The casting mold assembly further comprises a mold comprising a patterned region that defines an involute and comprises one or more gate openings that extend through the mold in the central patterned region. The molten metal is introduced to the cavity through the one or more gate openings in the central patterned region of the mold. The method further comprises solidifying the molten metal to form a solid scroll compressor component comprising the involute portion and removing it from the casting mold assembly.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 10:
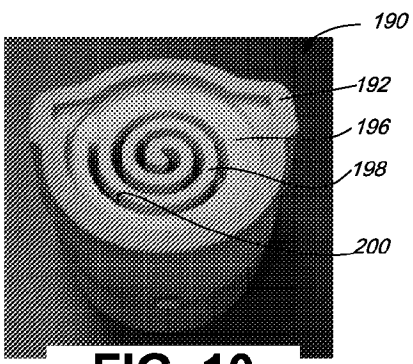
FIGS. 10-11 show perspective views of a core prepared in accordance with certain variations of the present disclosure for use in a casting mold assembly to form an orbiting scroll compressor component.
Figure 11:
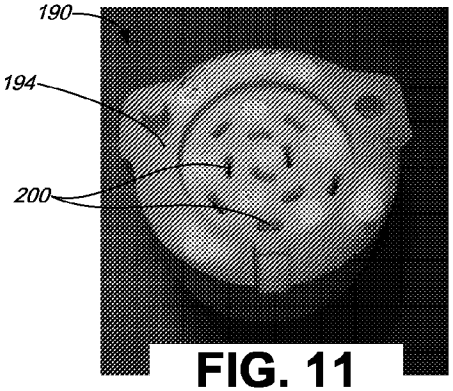
Figure 13:
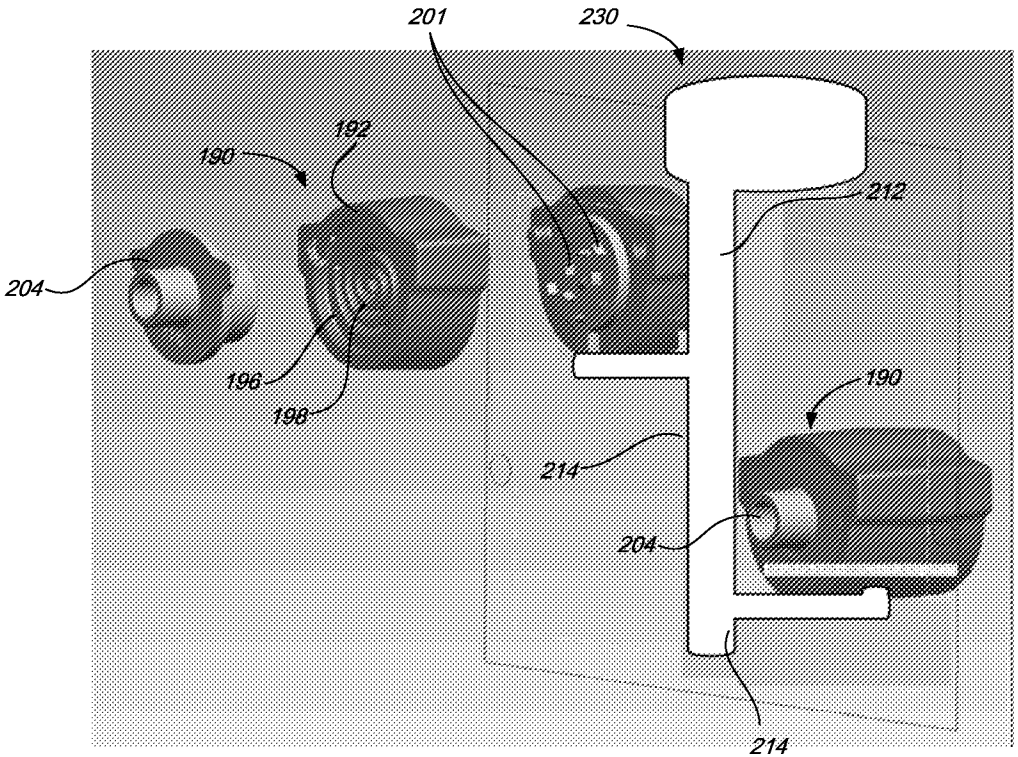
Figure 14:
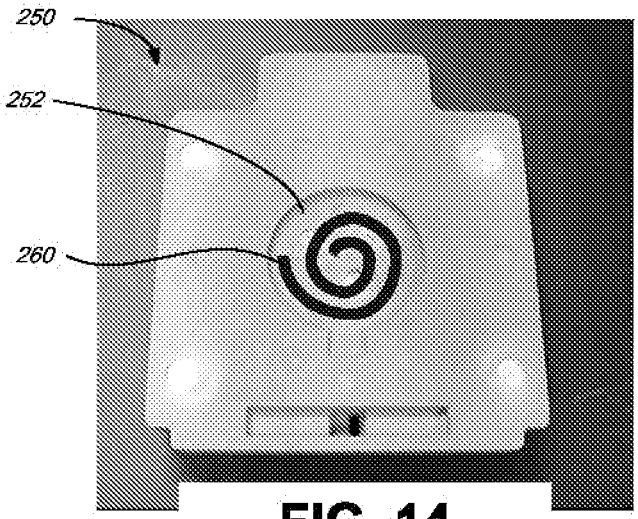

FIG. 13 is an exploded view of a dual molding assembly with solidified cast orbiting scroll components after the casting process with a core as shown in FIGS. 10-11; and FIG. 14 shows a perspective view of a core prepared in accordance with certain alternative variations of the present disclosure for use in a casting mold assembly to form a scroll compressor component by using a kiss gate configuration in a patterned central region of a core.

Corresponding reference numerals indicate corresponding parts throughout the several views of the drawings.

DETAILED DESCRIPTION

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

In various aspects, the inventive technology pertains to methods of casting scroll components for scroll compressors that are low cost, efficient processes, yet provide high quality cast metal scroll components. Casting methods are those where a molten metal is introduced into a casting mold assembly, followed by solidification and removal of the cast solid metal part from the casting mold assembly. The inventive technology is applicable to a variety of casting processes. By way of non-limiting example, the various casting processes for casting scroll components include the following well known techniques: green sand casting, shell molding casting, lost foam casting, or DISAMATIC™ sand casting.

A casting mold assembly may optionally include one or more molds and in certain processes, one or more cores. The molds and cores are formed of conventional casting materials that together are capable of retaining molten metal through the solidification process to form a cast metal component having a predetermined shape dictated by the mold assembly cavities. Typically, for green sand casting, shell molding casting, or DISAMATIC™ sand casting, a casting mold assembly comprises multiple molds that can be arranged to form an empty cavity or receptacle having the shape of the component to be formed. Thus, shells or molds form the exterior boundaries of the mold cavity of the mold assembly. Cores are solid components that define internal shapes or elements within the cast metal part and eliminate or reduce the need to form such internal shapes by additional post-casting machining or boring. The core(s) are usually placed within the open cavity defined by the mold(s) and can be adjacent to mold walls, spaced apart from the mold walls, or spatially arranged by core prints (formed in the surrounding mold that support a portion of the core) or pins/chaplets or by other well known placement means. As used herein, cores may be formed of a single integral piece or in alternative variations, may be an assembly of core pieces attached together. Remaining empty spaces define the cavity in the mold assembly and thus form the shape of the component/cast part after molten metal is introduced into the cavity and solidifies. After molten metal is poured into the assembly of molds and cores, it is left to cool, solidify, and form a metal part which is subsequently removed by well known processes from the mold assembly.

The cores may comprise one or more patterned regions that define a complementary shape to the component shape to be formed. Thus, the one or more patterned regions of a core are exposed to the open cavity of the mold assembly so that molten metal will contact the patterned region. In accordance with various aspects of the present teachings, a patterned region of the core of the casting mold assembly defines a shape of an involute portion of a scroll component, such that after the cavity is filled with molten metal, the patterned region of the core creates an involute portion (e.g., the spiral vanes) of a scroll component for a scroll compressor after metal solidification.

In the case of conventional green sand casting, a bulk of the casting mold(s) are formed of sand bonded with clay and water, while the scroll component involute shape is formed by a patterned region of a sand core. The sand core can comprise chemically-bonded or resin-bonded sand, which can provide the advantages of reduced draft angle and improved dimensional accuracy. In the case of shell molding, two or more sides of a mold form a mold cavity. The mold sides are typically formed by resin-bonded sand and an optional separate core with a patterned surface is optionally used to create the involute shape of a scroll component.

The DISAMATIC™ casting process is a well-known process for rapidly and automatically creating a string of vertically-molded sand castings. In the DISAMATIC™ process, a molding sand mixture is introduced into a molding chamber from above (e.g., gravity feed). An advancing ram compresses the sand in the molding chamber to form a mold impression having opposing halves of consecutive molds. One or more cores may be placed inside prior to the mold impression, for example to form the involute portion of the scroll component. The mold impression is then pushed into a mold string on an advancing conveyor, such that its leading edge meets the trailing edge of the previous mold to create a completed mold cavity. Down the mold string, molten metal is poured into the top of each of the completed mold cavities via a pouring sprue formed from pattern impressions. At the end of the conveyor, solidified castings are separated from the molds and optional cores for further processing.

In other variations, methods of casting can include forming a mold assembly from a plurality of molds made from an expendable foam material. Such a process is commonly referred to as "lost-foam casting." In such a process, one or more mold pieces formed of the expendable foam material create a mold assembly defining a component shape. Where the component shape to be formed is particularly complex, especially for scroll components, multiple expendable foam pieces can be joined together to form a mold assembly defining a complex scroll component shape, such as in the techniques taught in U.S. Publication No. 2009/0242160 to Obara et al., entitled "METHODS OF FORMING MODULATED CAPACITY SCROLLS," the relevant portions of which are incorporated herein by reference. A box or receptacle is filled with sand or other material disposed around the mold assembly. The scroll component is molded by displacing the mold assembly (made of expendable foam material) with a molten metal, generally by volatilizing the expendable foam material, which dissipates as it is replaced by the metal. After the expendable material is displaced with molten metal, the metal solidifies inside the surrounding sand or refractory material to form the scroll component having a shape corresponding to the original scroll component shape of the mold assembly. In the case of lost foam casting, the bulk of the sand is unbonded and cores of sand or other materials are used less frequently.

As discussed above, the potential for quality defects in conventional casting processes have tended to favor the application of premium casting methods, such as shell-molding and lost-foam casting. Less costly casting methods, such as various green sand techniques have also been used, but typically with only modest success owing to considerations related to tolerances and quality. For green sand casting, tolerances for the most important casting features, such as the involute of a scroll component, can be improved through the use of shell, cold-box or similar cores and through careful attention to the design of core patterned regions.

Unfortunately, for these conventional methods of casting, some sand-related and undercooling quality problems may still tend to remain. These quality issues have the potential to present difficulty in machining, among other issues. In the case of ordinary low cost horizontally parted molds, well known principles of design of the gating system (runners, gates, sprue bases, chokes, tails, and the like) can assist in mitigating some of these quality problems, but do not necessarily provide consistent high quality castings. In the case of low cost vertically parted molds, as produced on a DISAMATIC™ mold making machine, even the most carefully designed conventional gating systems have been less successful in avoiding the generation of loose sand and sand related quality defects. Furthermore, these techniques do not address the issues with undercooling defects and undesirable microstructural issues, particularly in the important involute portions of scroll components. Thus, casting methods provided by the present teachings can consistently, efficiently, and inexpensively form high quality, low defect scroll components.

Figure 5:
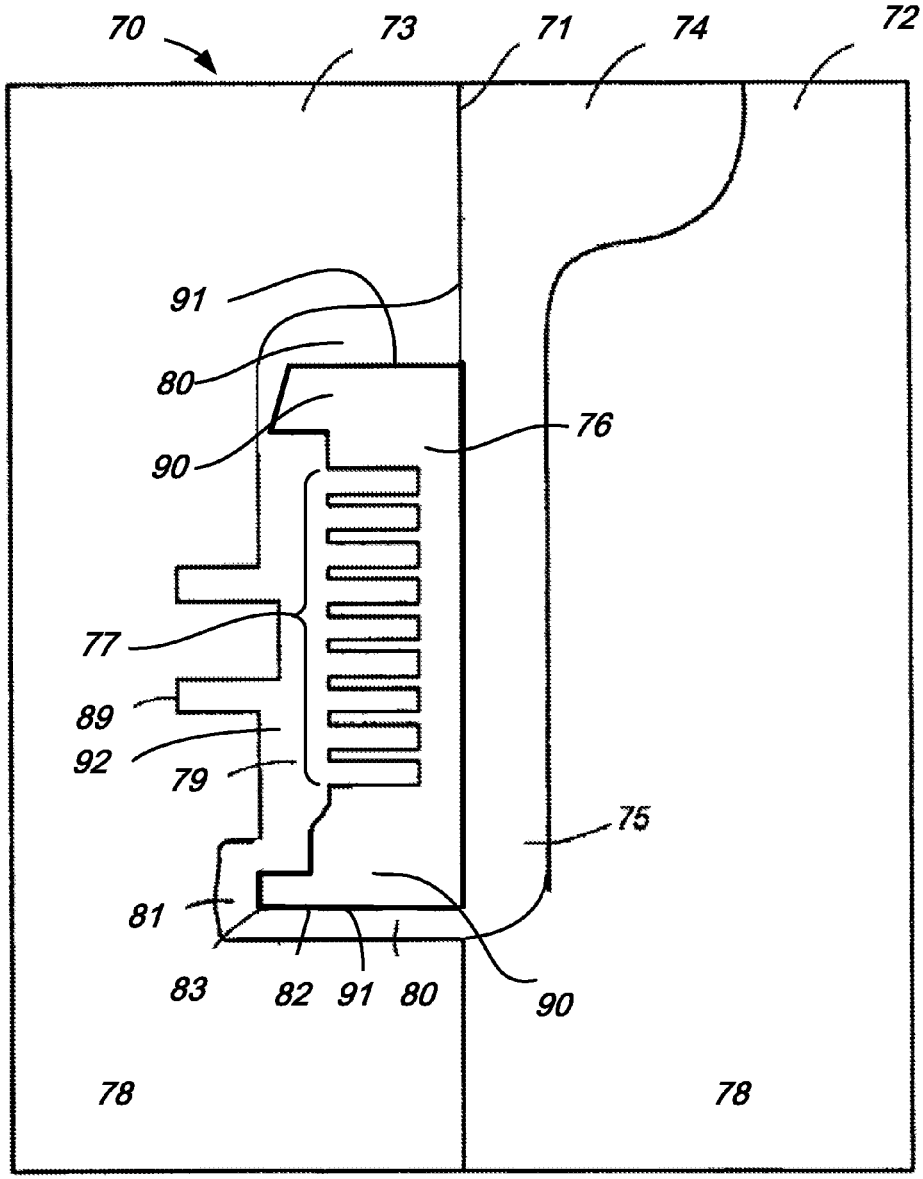
FIG. 5 represents a conventional sand mold assembly for casting.

To better understand the inventive principles and technology, by way of background, current conventional methods of casting scroll components are described in more detail herein. For example, conventional casting methods for scroll components include those taught by U.S. Pat. No. 6,860,315 to Williamson entitled "GREEN SAND CASTING METHODS AND APPARATUS," which is expressly incorporated by reference in its entirety. In various aspects, a casting process involves introducing a molten metal via a sprue to a system of gates and runners into one or more closed mold cavities formed by a mold assembly (optionally having one or more cores disposed therein). FIG. 5 shows one exemplary conventional sand mold assembly 70 used to form a scroll compressor component. As will be discussed in greater detail below, conventional practice for the production of cast scroll components with an involute portion is to locate a small passageway(s) known as an in-gate (or riser neck) at a mold parting line on a perimeter of a mold cavity. Although this conventional practice is workable, it presents potential disadvantages, including a tendency to produce undercooled microstructure (e.g., for ferrous alloys, the formation of Types D & E graphite, ferrite and large carbides) at involute portion vane tips. Furthermore, in conventional processing, heightened care must be taken during casting to avoid potentially trapping contaminants within the long, narrow involute portions.

FIGS. 1-4 depict illustrative examples without limitation, of typical scroll component structures that can be employed in combination with one another in a scroll compressor. The structures shown are cast as integral structures. The skilled artisan will appreciate that FIGS. 1-4 are for illustration purposes only (e.g., to demonstrate the geometric intricacies of scrolls) and are not intended to be limiting as to the structure or design of the scroll component to which the present inventive teachings apply. The present disclosure contemplates a variety of different cast metal components or structures, including scroll component designs other than those shown in FIGS. 1-4.

Figure 1:
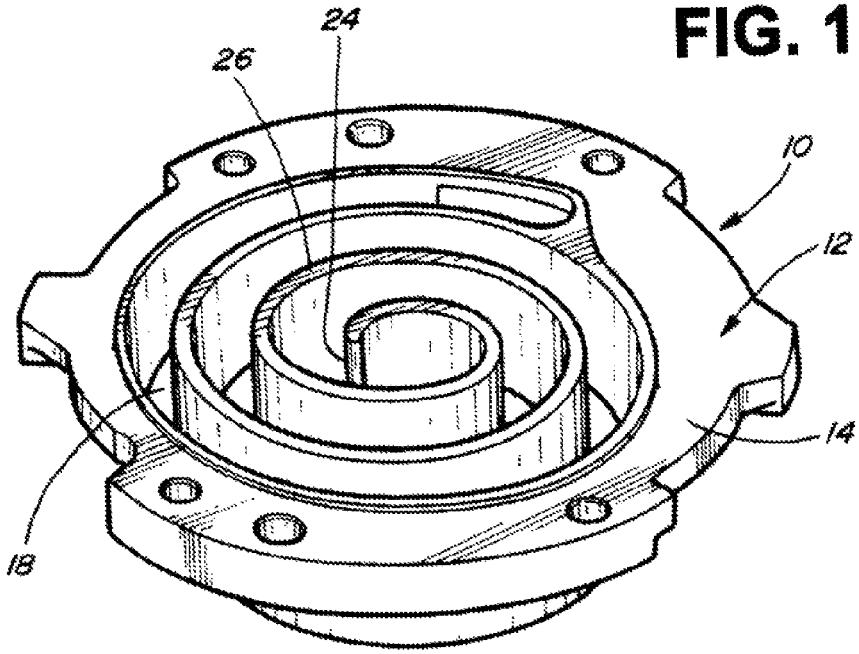
FIG. 1 is a perspective view of a fixed scroll component for a scroll compressor.
Figure 2:
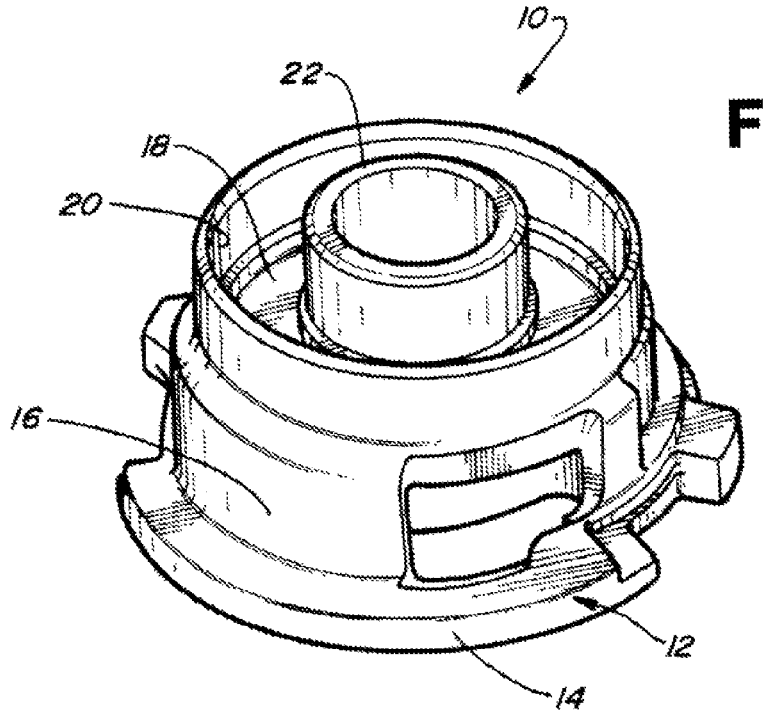
FIG. 2 is another perspective view of an opposite side of the fixed scroll component from FIG. 1.

FIGS. 1 and 2 illustrate two opposite sides of a typical scroll structure for a fixed scroll component 10. The function and operation of such a scroll will be appreciated and understood by those of skill in the art. The fixed scroll component 10 includes a first baseplate portion 12 having a first plate member 14, a wall 16 extending from the first plate member 14 (best seen in FIG. 2), and a second plate member 18. A sealing flange 20 extends away from the second plate member 18 (about the periphery of the second plate member 18). A sealing collar 22 within the sealing flange 20 extends away from the second plate member 18. A first spiroidal vane or involute portion 24 extends from a surface of the second plate member 18 on a side opposite to that from which the sealing collar 22 originates. The spiroidal involute portion 24 ends at a terminal end 26, thus defining an involute vane tip.

Figure 3:
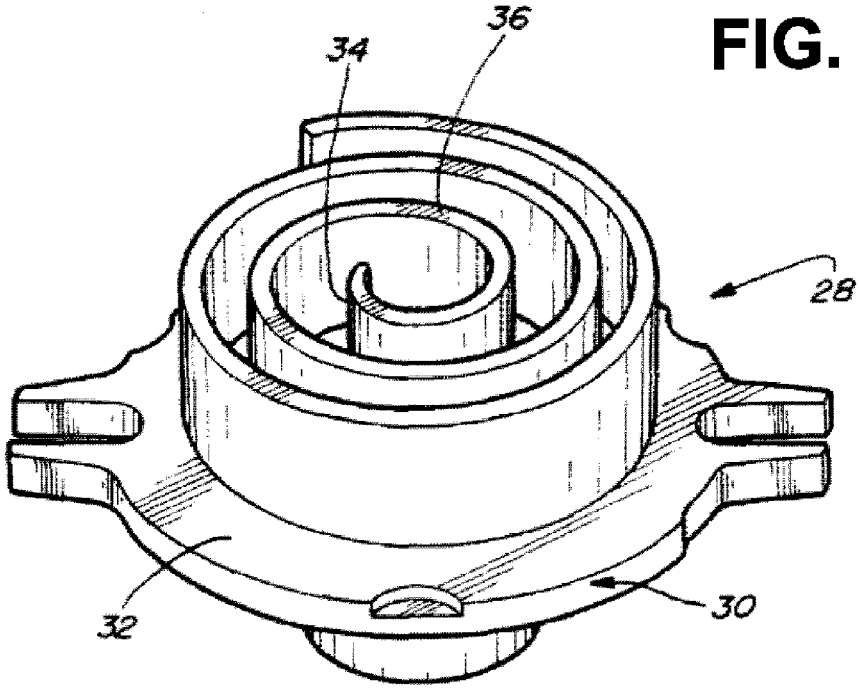
FIG. 3 is a perspective view of an orbiting scroll component for a scroll compressor.
Figure 4:
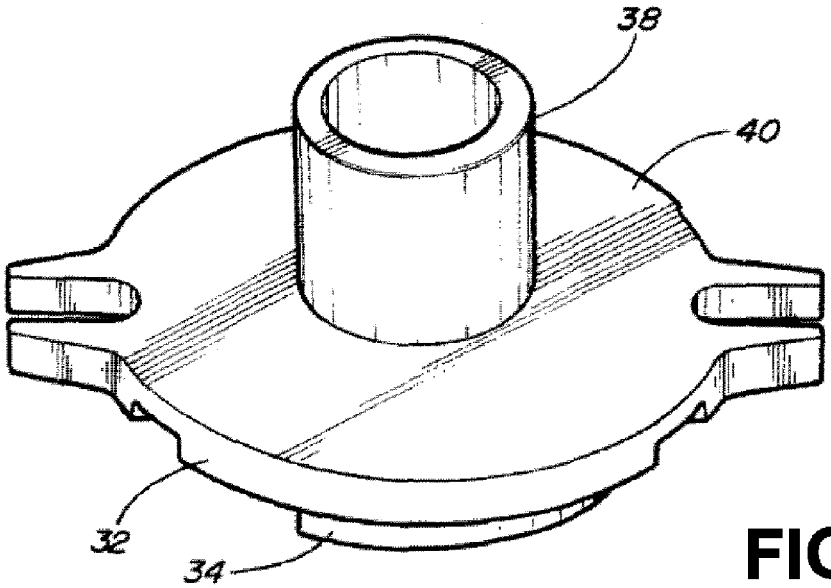
FIG. 4 is another perspective view of an opposite side of the orbiting scroll component from FIG. 3.

Referring to FIGS. 3 and 4, an example of a typical orbiting scroll component 28 is shown. The orbiting scroll component 28 has a second baseplate portion 30. The second baseplate portion 30 includes a third plate member 32 defining a surface from which a second spiroidal vane or involute portion 34 extends. The second involute portion 34 ends at a terminal end 36 that defines involute vane tips. A hub 38 extends from a surface 40 of the third plate member 32 in a direction opposite to that from which the second involute portion 34 extends.

With renewed reference to FIG. 5, the sand mold assembly 70 is used to form an exemplary scroll component (shown as an orbiting scroll component, like orbiting scroll component 28 in FIGS. 3-4). Sand mold assembly 70 has a vertical parting line 71 and a first side mold 72 and a second side mold 73. The mold assembly 70 is formed using green sand molding material 78, which can be a molding material comprising sand and/or clay that are well known in the art. Additionally, the mold assembly 70 contains a core 76. The core 76 defines details of certain features of the particular cast component, and can have one or more imprint surfaces or patterned regions 77 so as to define features of the scroll component to be formed. As noted above, in certain aspects, the core is formed of a single integral body, but in alternative aspects, may be formed from an assembly of distinct pieces that together form the core. Notably, second side mold 73 itself is patterned to define a hub feature 89 and one side of a baseplate portion 92.

The core 76 also includes radially outward lateral regions 90 (along external surfaces 91 corresponding to the outer boundaries of the core 76) in addition to the centrally disposed print or patterned region 77. When the core 76 is oriented in the casting mold assembly 70 as shown, the lateral regions 90 are oriented so as to form an upper region and a lower region (although the core 76 has a round or rectangular shape, so the lateral regions 90 occupy the outer peripheral regions of the core 76). Further, the central patterned region 77 defines a shape that ultimately forms an involute portion of the cast scroll component. At least one of the side molds 72, 73 defines a pouring basin 74 which is in fluid communication with a sprue 75. It should be appreciated that the molten metal delivery systems described herein are shown in simplified exemplary configurations, but may have different configurations and alternative components than those described there, including different configurations of such components and/or different numbers of sprues, gates, runners, risers, and the like. As shown, the second side mold 73 has the core 76 incorporated therein, although other configurations of the molds and core in the mold assembly 70 are contemplated. The core 76 can be formed in conventional core-formation processes known in the art, such as a shell or cold box process for a resin bonded sand.

Thus, the first side mold 72 defines the sprue 75 and pouring basin 74, and the second side mold 73 has an open cavity 79 defined therein. At least one opening or gate 80 (here shown to be two gates, including both upper and lower gate openings 80) is formed into the second side mold 73 external surfaces 91 of the lateral region 90 of core 76 to permit fluid communication between the sprue 75 and cavity 79. The gate opening 80 can take the form of a notch gate or flow channel. In this way, the molten metal enters the cavity 79 in a conventional casting process like that shown by passing through the gate openings 80 around the exterior surfaces 91 of outer edge 83 of core 76 to enter into the cavity 79 at the portion of the scroll component corresponding to a baseplate portion. A backsplash 81 can be formed into sand molding material 78 in the second side mold 73, which prevents the inflowing molten metal from impinging on green sand molding material 78 at a location where the molten metal must change direction 82. While not shown, two opposite faces of each side mold can include impressions of the first and second side patterns respectively. In this way, a continuous string of molds can be efficiently assembled, such as in a DISAMATIC™ process.

As shown in FIG. 5, design of side patterns for generating the sand casting mold assembly 70 involves including the patterned regions 77 of core 76 in the same side 73 of the sand casting mold assembly 70, which includes the portion of green sand molding material 78 of the mold cavity 79. Notably, second side mold 73 itself is patterned to define a hub feature and one side of a baseplate portion. In the exemplary casting mold assembly in FIG. 5, the first side mold 72 contains no features of the cast part, containing instead the pouring basin 74 and the sprue 75. This reduces the surface area of green sand molding material 78, which is exposed to high velocity molten metal. While not shown in FIG. 5, one or more fusible plugs can be used in the gate openings 80 or sprue 75 to significantly reduce the amount of turbulence caused by velocity changes of the molten metal and reduce the amount of erosion induced defect material within the final product.

Figure 6:
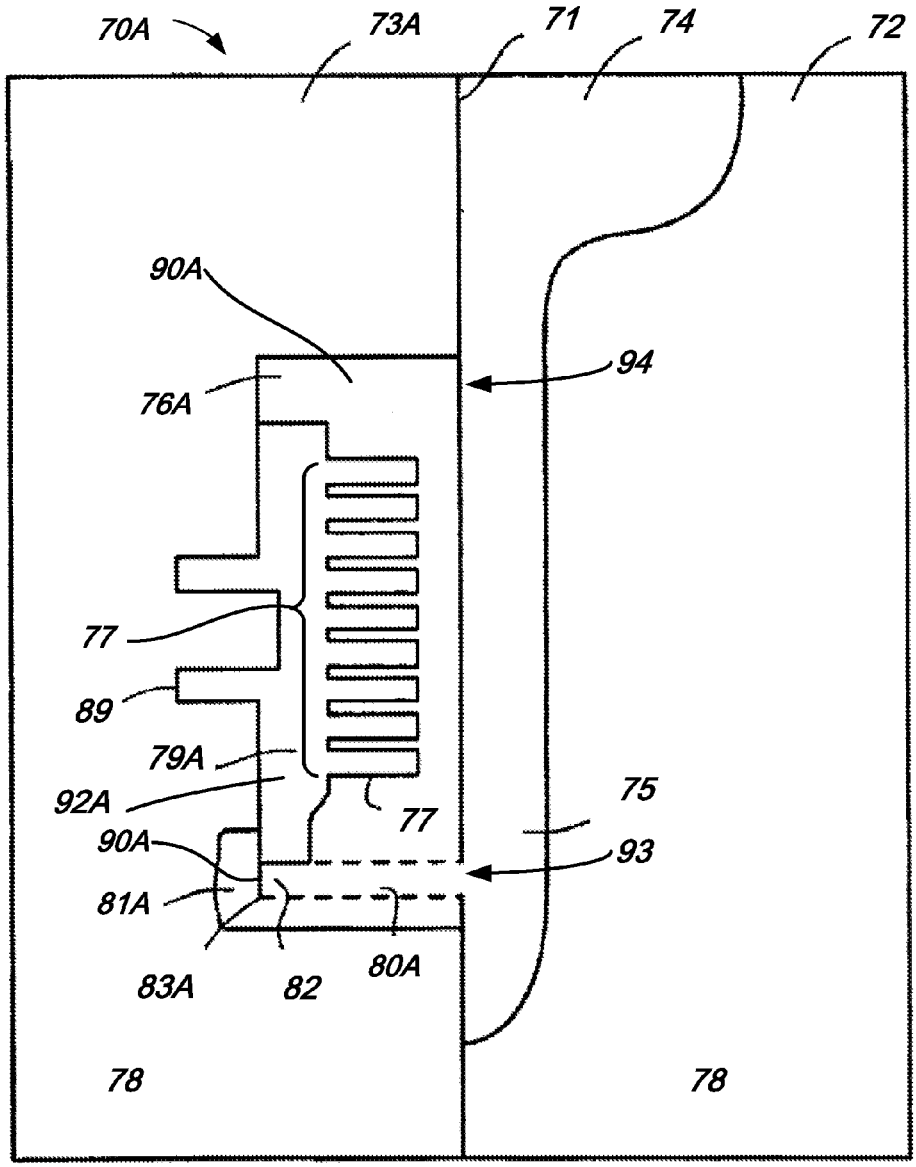
FIG. 6 represents an alternative conventional sand mold assembly for casting.

An alternative embodiment of a conventional casting technique, which is further described in U.S. Pat. No. 6,860,315, is shown in FIG. 6. A sand mold assembly 70A is used to form a scroll compressor component. For brevity, to the extent that the casting assembly components are the same as those described above in the context of FIG. 5, discussion of these components will not be repeated herein an the same reference numbering applies. As shown in FIG. 6, design of side patterns for generating the scroll component are similarly confined to second side mold 73A rather than in first side mold 72. Second side mold 73A includes core 76A, which together with the pattern of green sand molding material 78 of second side mold 73A defines mold cavity 79A.

However, in the mold assembly 70A, instead of the molten metal flowing around the core 76 like in FIG. 5, in the casting process of FIG. 6, core 76A itself comprises an in-gate or gate opening 80A that passes through outer edge 83A and opens into cavity 79A and through which molten metal can flows during casting. Notably, in the configuration shown in FIG. 6, the molten metal flows through the sprue 75 and gate opening 80A only along a lower region 93 of the molding assembly 70A (no introduction points to cavity 79A are provided along the upper regions 94 of the cavity 79A) so that molten metal only fills the cavity 79A from the bottom or lower region 93.

In such conventional casting processes like that shown in FIG. 6, one or more gate openings 80A are openings formed through the bulky lateral regions 90A that extend through the outer edge 83A of the core 76A. The gate opening 80A can take the form of a notch gate or a hole defined through the side or lateral region of core 76A. In this way, the molten metal enters the cavity 79A in a conventional casting process like that shown by passing through the end/lateral region 90A of core 76A via gate opening 80A, where it then enters cavity 79A at the portion of the scroll component corresponding to a baseplate 92A.

Whether the gate opening 80A is a simple through-hole, an edge gate, a notch gate, or the like that provides fluid communication from the sprue 75 through the core 76A into cavity 79A, in each circumstance, the gate opening 80A has been conventionally disposed in regions where no complex patterning is required, for example, along the external sides or ends in the lateral regions 90A of the core 76A that did not have patterning for simplicity of core formation. Further, formation of the gate opening 80A through the bulky lateral region 90A of core 76A provides structural integrity for the metal passageway. Thus, when forming scroll compressors, the gate opening 80A has not previously been formed through the centrally disposed core patterned regions 77, for example.

As shown in FIG. 6, the core 76A can also define a resin bonded backsplash 81A which prevents the inflowing molten metal from impinging on green sand molding material 78 at a location where the molten metal must change direction 82. The backsplash 81A can be formed integrally with the core 76A in the lower lateral region 90A. Also, while not shown, plugs or filters may be employed in any of the sprues, gates, risers, or the like.

It has been discovered that cast components, in particular scroll components formed in accordance with conventional casting techniques like those described in conjunction with FIGS. 5 and 6, could suffer from potential defects. During casting processes, the initial metal that flows into the mold cavity tends to have higher levels of impurities, and thus is potentially contaminated (e.g., is compositionally distinct from the desired composition and potentially entrained with debris that can form defects), whereas the final metal to enter the cavity tends to be the "cleanest" and most similar to the intended composition. Thus, when molten metal is introduced into a cavity in conventional casting of a scroll component near the baseplate portion, the more contaminated metal enters and fills the imprint or patterned regions (77) of the core (76 or 76A) corresponding to involute portions of the scroll component early in the casting process. As noted previously, in conventional casting methods, the involute portion of the cavity (e.g., regions of cavity 79 or 79A adjacent to the patterned surface region 77 of core 76 or 76A) have the potential to behave as physical traps to accumulate debris, leading to potential inclusions and defects in the involute portion of the cast scroll component. Such inclusions and defects are disadvantageous both for the structural integrity of these portions of the cast scroll component, as well as for post-casting machining.

Thus, cast metals in the involute portions made by conventional casting techniques have a far greater potential to be formed with defects or poor characteristics, including undercooled and microstructurally deficient materials in the involute portion/vane tips of the scroll component. Notably, the microstructure of the metallic involute portion of the scroll component is of primary importance as compared to other regions of the cast scroll component. First, the involute regions typically require significant machining of the involute portion for cast metal components due to the high tolerances required. Second, the involute portion is exposed to the significant pressures and high mechanical stresses during compressor operation, so the involute portion is a region of the scroll component that is particularly vulnerable to challenging environments.

Further, conventional gating systems, even if gated through the peripheral regions of the core itself (like in the techniques shown in FIG. 6), typically have introduction points into the baseplate region(s) of the cavity (e.g., either baseplate portion 92 of cavity 79 in FIG. 5 or baseplate portion 92A of cavity 79A in FIG. 6). As such, the molten metal may cool significantly from a target pour point temperature prior to reaching and filling the long, thin openings of the cavity corresponding to the involute portion (portions of the cavity 79, 79A adjacent to the patterned regions 77 of core 76, 76A). Undercooling promotes formation of undesirable species in the metallic microstructure (referred to herein generally as "undercooling defects") including undesirable formation of certain types of intermetallic species and graphite forms.

Such undesirable undercooling defect species in ferrous alloys include chill formation, for example, where large domains of an undesirable intermetallic white iron (where carbon in molten iron does not form graphite on solidification, but remains combined with iron in the form of massive carbides) or primary iron carbides ($Fe_3C$) are formed as a result of undercooling of the metal during casting. Likewise, so called cold-shuts or cold-laps can be formed, which are surface defects where iron cools prematurely and freezes to form a discontinuity between two molten regions that failed to unite. Additionally, undercooling in involute regions of a cast metallic scroll component piece can result in microstructurally deficient material with poor properties at the involute vane tips. Each of these different types of undercooling defects has a particularly significant impact on the structural integrity of involute portions of scroll components.

Therefore, in various aspects, the present teachings avoid generation of potentially undercooled and microstructurally deficient materials or other defects that may result in poor properties at the involute vane tips. While conventional casting processes can have relatively thick regions (e.g., several mm layers) of such undercooled or microstructurally deficient material present in the involute region, such undesirable material is desirably avoided by the inventive technology. In accordance with certain aspects of the present disclosure, involute portions of the solidified cast scroll compressor component are substantially free of undercooling defects, including undercooling species, or microstructurally deficient material. The term "substantially free" as referred to herein means that the defect is absent to the extent that that undesirable and/or detrimental effects attendant with its presence are avoided. In certain embodiments, an involute portion that is "substantially free" of undercooling defects comprises less than about 5% by weight of the undercooling species or defects, more preferably less than about 4% by weight, optionally less than about 3% by weight, optionally less than about 2% by weight, optionally less than about 1% by weight, optionally less than about 0.5% and in certain embodiments comprises 0% by weight of the undercooling defects.

Thus, in various aspects, the present disclosure provides methods for casting improved scroll compressor components with high quality cast involute portions. The methods comprise introducing a molten metal into a casting mold assembly. In certain variations, the mold assembly comprises a mold and a core. While the mold and core components are referred to here as being present as single components, the present teachings are equally applicable to those casting mold assemblies comprising a plurality of molds and/or cores. The core comprises a patterned region that will define an involute of a cast scroll component. Thus, the mold and the core together define a cavity having a shape of a scroll compressor component comprising an involute portion (corresponding to the centrally disposed patterned region of the core). Furthermore, in alternative aspects, the present teachings are also applicable to forming one or more portions of the scroll component separately by casting, for example, forming an involute wrap or a hub portion independently by casting and later coupling the cast part forming in accordance with the present teachings with other independently formed scroll component portions or parts.

In accordance with various aspects of the present teachings, the core comprises one or more gate openings that extend through the core (from one side to the other) in a centrally disposed patterned region that defines the involute of the scroll component. Hence, molten metal is introduced to the cavity through the one or more gate openings in the involute portions of the patterned region of the core. Thus, in accordance with certain aspects of the present teachings, molten metal is introduced to the cavity through the vane tips or involute portions of the scroll component via the core. The molten metal is then solidified to form a solid scroll compressor component comprising the involute portion and removing it from the mold assembly. It should be noted that in certain alternative variations, the molten metal may also be gated through one or more openings through the elongated and thin regions of the hub portion or other regions of the scroll compressor component susceptible to fatigue and defect formation. In certain variations, the method further comprises machining the involute portion of the solid scroll compressor component after the solidifying.

Figure 7:
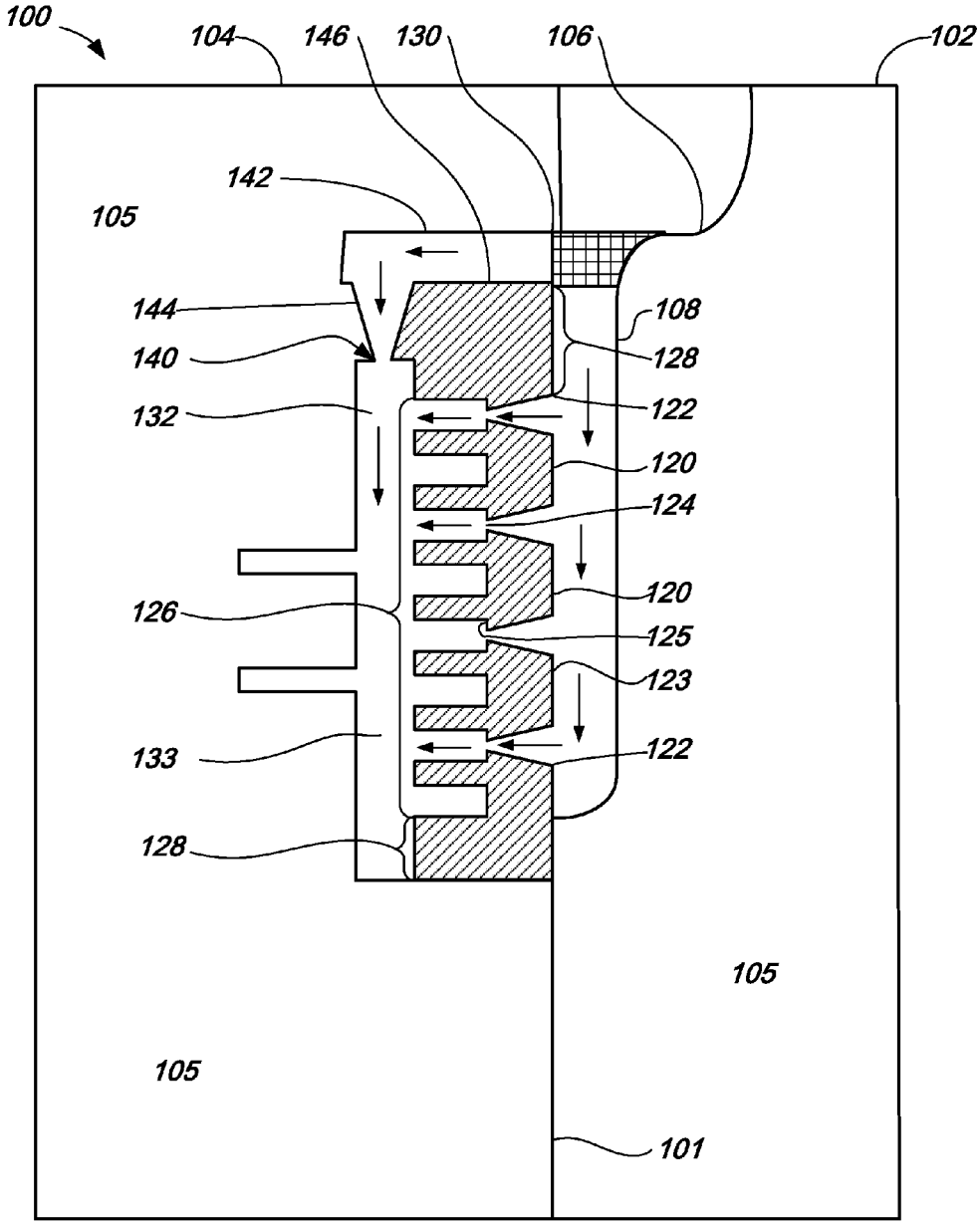
FIG. 7 represents a sand mold assembly for casting according to various aspects of the present disclosure.

Because the molten metal (e.g., iron alloy) cools somewhat as it flows axially from the in-gates of the core in the patterned region towards the baseplate portion, any metal near the baseplate portion is slightly cooler than in the involute tips (e.g., 26 and 36 in FIGS. 1-4). FIG. 7 shows a mold assembly 100 for forming an exemplary scroll component (shown as orbiting scroll component 28 in FIGS. 3-4) in accordance with various aspects of the present teachings. The mold assembly 100 has a vertical parting line 101 and comprises a first side mold 102 and a second side mold 104. The mold assembly 100 is shown with green sand molding material 105 comprising sand and/or clay, which are well known in the art. It should be noted that FIG. 7 is exemplary of the casting methods of the present disclosure; however, other configurations and casting techniques are contemplated for use in conjunction with the features described in the present teachings as discussed previously above. Thus, the configuration in FIG. 7 can be readily modified to be used with other casting processes, as understood by those of skill in the art. At least one of the side molds 102,104 defines a pouring basin 106 that receives molten metal during casting which is in fluid communication with a sprue 108. It should be appreciated that the molten metal delivery system may have different configurations and components than those described here, including different configurations and numbers of sprues, gates, runners, risers, and the like, and the descriptions contained herein are merely exemplary.

Mold assembly 100 further comprises a core 120. The core 120 has one or more imprint surfaces or patterned regions 126 that define intricately shaped features of the scroll component to be formed. In preferred aspects, the patterned regions 126 are centrally disposed in the core 120 and surrounded by lateral regions 128 of the core 120 disposed radially outward along an outer boundary of the core 120. In various aspects, the central patterned region 126 defines a shape that ultimately forms an involute portion of the cast scroll component (e.g., involute portions 24 or 34 of scroll components 10 and 28 of FIGS. 1 and 3). As shown, the second side mold 104 has the core 120 incorporated therein, although other configurations of the molds and core in the mold assembly 100 are contemplated.

By way of background, conventional casting materials to form a core or a mold can contain an aggregate, like a foundry sand (bank and/or synthetic sands) optionally combined with a binder resin. A combination of an aggregate and binder are preferably used to form a core material. The material mixture can be shaped into a core (or mold) by placing it into a pattern and allowing it to cure until it is self-supporting and capable of being handled. In accordance with the present teachings, a pattern can be used to form a core that includes means to form one or more openings or gates in an involute portion of the core, as are well known in the art. When a mixture of casting materials is formed, it can be further treated to solidify the casting material mixture by cross-linking or curing the binder resin. Typical binders include no-bake, cold-box, or hot-box (e.g., shell molding).

For example, hot-box treatment includes pre-heating (e.g., at temperatures ranging from about 40° C. to about 260° C. by way of non-limiting example) for a thermosetting binder resin to cure or set. Cold-box treatment involves curing typically achieved by a vapor or gas catalyst passed through the casting material mixture, which induces curing, sometimes conducted at slightly elevated temperatures (e.g., at temperatures of about 35° C. to about 100° C. by way of non-limiting example) to ensure vaporization of the catalyst. A no-bake system cures without any baking or heating (cures at ambient temperatures by way of non-limiting example) where a catalyst is added directly to the material mixture. Usually, in such systems, a no-bake catalyst is admixed with the material mixture and then formed into a shaped mold where it subsequently solidifies.

In certain aspects, the binder employed for the core comprises a phenolic resin. For example, a binder comprising a phenolic resin, such as a phenolic urethane binder, can be employed in both the no-bake and cold-box processes. The difference in the curing method of phenolic urethane binder is related to use of different solvents (binder system) in which the binder is dispersed. For a no-bake system, a different solvent is used which reacts with a liquid curing catalyst mixed into the material mixture. The liquid catalyst is mixed into the material mixture before shaping and cures within a short time thereafter (from a few minutes to a few hours later). In a cold-box resin process, a gaseous catalyst, such as a tertiary amine curing catalyst (e.g., TEA (tetraethylamine) and DMEA (dimethylethylamine)), is passed through a shaped material mixture containing a phenolic binder (typically consisting of a phenolic resin component and optionally including a polyisocyanate component to form a phenolic urethane binder) for curing. Phenolic containing binders, such as phenolic urethane binders, are widely used to bond the sand cores for iron and aluminum casting.

Hot-box fabrication processes use resins that harden the sand when the material is pre-heated to temperatures of about 35° to about 300° C. Such an example of hot-box fabrication includes shell molding, where the shell is formed from a mixture of sand and a thermosetting resin binder that is placed against a heated metal pattern or template. The heat induces resin setting, forming a solid mold or core. Typical hot-box or shell molding resins optionally include binders comprising furan resins and furfuryl alcohols. Typically, such resins are cured in the presence of a latent acid curing catalyst. Ceramic mold mediums are another example of a hot-box treated mold, where the inorganic clay components, like aluminum silicate, bentonite, or montmorillonite, form the binder. They can be formed by layering a lost wax/foam mold with successive layers of a slurry of sand and inorganic binder then are then cured with heat. In certain variations, core 120 can be formed in conventional core-formation process known in the art and like those described above, such as a hot-box/shell process or cold-box process for a resin bonded sand.

At least one opening (e.g., a gate opening) 122 is formed into the core 120 so as to permit fluid communication between sprue 108 and cavity 132. Preferably, the one or more gate openings 122 are centrally disposed in the core 120. As used herein a gate or opening refers to a channel that permits fluid communication from one region of the mold assembly to another, but could also be categorized as a riser or other known feature of conventional casting gating systems, for example. In various aspects, a plurality of gate openings 122 is formed into the core 120. Regardless of the casting method, in certain aspects, a diameter or cross-sectional area of the gate openings in the core is selected so as to be large enough to permit a sufficient flow rate of molten metal (e.g., iron alloy) for both timely filling of the cavity in the mold and for attaining Type A graphite in the involute portion vane tips, yet small enough to provide for easy removal without damaging the involute and without the need for sawing or cutting. Therefore, the number, shape, and cross-sectional area of gate openings formed in the core 120 is selected to provide adequate flow rates of molten metal to fill the cavity 132 in a pre-selected casting interval, while advantageously providing the desired metal purities and metal temperatures during casting.

As shown in FIG. 7, the gate openings 122 have a tapered shape so that each gate opening 122 narrows as it enters cavity 132. In certain variations, the gate openings 122 are tapered from a first surface 123 of the core 120 to a second surface 125 of the core 120. In certain variations, the gate openings 122 have a trapezoidal (e.g., rectangular) cross-sectional shape, which extends across from the first surface 123 to the second surface 125 to form a three-dimensional cubic or truncated pyramidal tapered shape. However, other cross-sectional shapes are contemplated, including oval or round shapes that can form a three-dimensional cylinder or tapered cylinder. In certain variations, the gate openings 122 have a shape selected from the group consisting of: a tapered cylinder, a pyramid, a tapered cube, and combinations thereof. The gate openings 122 may be independently selected to have different shapes or different dimensions from one another. Notably, round or oval cross-sectional gate openings 122 can pose more difficulties during removal of the core materials after casting, thus in certain aspects, cubic or pyramidal shapes are selected. Regardless of shape, a plurality of in-gate openings 122 can be positioned at intervals along the patterned region 126 of the core 120 to ensure that the entire cast involute portion of the scroll component receives clean, undamaged metal.

The shape and number of gates described herein have been experimentally developed for certain scroll components; however, are not limiting as to the designs contemplated. For example, as shown in the cross-sectional view of FIG. 7, a plurality of at least four gate openings 122 is formed into the core 120 to permit distinct channels of fluid communication (and thus distinct introduction points of molten metal) into cavity 132. In certain variations, a core 120 comprises at least four gate openings 122 that open through involute portion tip regions 124 into the cavity 132 in the centrally disposed patterned region 126, which ultimately corresponds to the involute portion of a scroll component cast; optionally at least five gates; optionally at least six gates, optionally at least seven gates; optionally at least eight gates; optionally at least nine gates, and in certain variations greater than or equal to about ten gate openings 122 in the patterned region of the core 120. However, it should be noted that in certain alternative embodiments, such as the one shown in FIG. 14, a single elongated spiroidal "kiss-gate" configuration can be employed where a single elongated spiroidal gate 260 (or alternatively discrete elongated gates) form an elongated opening along the core 250 in the patterned region 252 centrally disposed along a tip of an involute portion. Such an alternative variation having a continuous or nearly continuous "kiss" gate in a spiral form permits molten metal to enter the cavity along the entire length of the involute portion in the patterned region of the core.

In certain variations, methods of casting a scroll compressor component may comprise introducing a molten metal into a casting mold assembly defining a cavity having a shape of a scroll compressor component comprising an involute portion. The casting mold assembly further comprises a mold comprising a patterned region that defines an involute and comprises one or more gate openings that extend through the mold in the central patterned region. This embodiment is similar to the core, but instead has the one or more gate openings formed in the central patterned region in a mold. Such an embodiment may be used in casting techniques that avoid the use of cores, for example. The variations and benefits described above are likewise contemplated for the present embodiment where the one or more gate openings are formed in the mold that defines the involute portion of the scroll compressor component. Thus, in accordance with certain variations of the present teachings, the molten metal is thus introduced to the cavity through the one or more gate openings through the vane tips or involute portions in the central patterned region of the mold itself. The method further comprises solidifying the molten metal to form a solid scroll compressor component comprising the involute portion and removing it from the casting mold assembly.

For a 3 kilogram (kg) fixed scroll component having an involute portion with dimensions of approximately 80 mm diameter and 5 mm thickness at the involute vane tips, nine rectangular involute gate openings 122 are formed in the core 120, where each gate has dimensions of approximately 1.5 mm by 9 mm. For a similar sized orbiting scroll weighing 1.5 kg, each of ten involute in-gate openings 122 is approximately 4 mm and round in shape to permit a greater flow rate.

As noted previously, the first metal that enters the mold cavity tends to be somewhat damaged and contaminated, whereas the last metal to enter the mold cavity is the most pure and undamaged. In accordance with the present teachings, the purest metal to enter the cavity fills the involute portion last, meaning that the highest quality and hottest metal enters the involute portion last to form the highest quality cast metal, thus benefitting both machining and fatigue life. While this requires far more complex patterning of the core, because the flow of molten iron through the involute warms that portion of the mold cavity through the entire period of mold filling, ability to cast long, thin vanes free of chill and cold-shuts is markedly improved, without the need to resort to excessively high pouring temperatures. Where the molten metal comprises an iron alloy with carbon, such a casting technique promotes formation of finer graphite flake sizes in the involute portion of the scroll component where it is most needed, and further provides measurably superior fatigue life.

It should be noted in FIG. 7 that an optional second introduction point 140 into cavity 132 in a region corresponding to the baseplate portion 133 is depicted as part of the gating system. The pouring basin 106 is in fluid communication with a runner 142 formed in molding material 105 of second side mold 104 that leads to an ancillary side gate 144 (or riser) in fluid communication with cavity 132. In this way, molten metal also enters the cavity 132 by passing around an exterior terminal surface 146 of core 120 to enter into the cavity 132 at the portion of the scroll component corresponding to a baseplate portion 133. Thus, molten metal poured into the pouring basin 106 can enter runner 142, pass through ancillary side gate 144, and enter the cavity 132 at the baseplate portion 133, while concurrently molten metal also passes into sprue 108 and through gate openings 122 into the cavity 132 via through involute portion tip regions 124. In this way, the cavity 132 can be filled more rapidly providing shorter cycle time, while still providing the advantages associated the inventive technology, including high quality, low defect involute portions. The ancillary side gate 144 may include multiple different gates or risers and placement of such ancillary gate(s) is not limited to the location shown.

Optionally, a fusible plug or ceramic filter 130 like those well known in the art may be incorporated into the gating system to reduce flow in the gating/metal delivery systems. The fusible plug and/or filter 130 is optionally used below the pouring basin 106 and above the sprue 108 and adjacent runner 142, for ease in placement.

Pour temperatures for molten materials depend upon the volume of the component to be cast, the metals compositions, and other factors well known to those of skill in the art. When ferrous alloys like a gray iron are selected to form the cast component, a suitable range of pour temperatures for the molten metal as it is introduced into the mold assembly can range from greater than or equal to about 2,400° F. (about 1,316° C.) to less than or equal to about 2,600° F. (about 1,427° C.); and in certain aspects, optionally greater than or equal to about 2,480° F. (about 1,360° C.) to less than or equal to about 2,580° F. (about 1,416° C.), by way of non-limiting example.

Casting methods such as cored green sand and lost foam are especially well suited to certain variations of the inventive technology, as the cost and complexity of such casting methods remain mainly unmodified. Shell molding and other resin bonded sand molding processes are also functionally well suited to the inventive processes; however mold complexity and cost are somewhat increased due to the need for a separate core to form the involute portion/vane tips to provide the in-gates. For example, while not shown, in certain alternative embodiments, straight runner bars, one or more per mold cavity and running perpendicular to a scroll axis, can communicate through centrally disposed in-gate openings in the core to the involute at the involute vane tips. One such runner bar can provide molten metal to multiple gates, for example, up to about five in-gates, and furthermore, in the case of lost foam casting, can provide an additional benefit of reinforcing and improving rigidity of the foam pattern prior and during the casting process. Thus, the teachings of the present disclosure are broadly applicable and advantageous to various casting methods commonly employed to make scroll components.

Furthermore, it should be noted that in certain variations, the present disclosure contemplates casting methods that do not employ a core, but rather form the complex involute pattern on one side of a mold. Thus, in such variations, gating preferably occurs through one or more gate openings formed in the mold (e.g., side mold) pattern in the regions corresponding to involute portion. In this regard, advantages associated with the inventive technology are likewise realized.

Thus, in such alternative variations, a method of casting a scroll compressor component is provided that comprises introducing a molten metal into a casting mold assembly. The mold assembly comprises a mold that defines a central patterned region defining an involute and one or more gate openings that extend through the central patterned region. The mold assembly further defines a cavity having a shape of a scroll compressor component comprising an involute portion corresponding to the central patterned region. Molten metal is introduced to the cavity through the one or more gate openings in the central patterned region of the mold. The method further includes solidifying the molten metal to form a solid scroll compressor component comprising the involute portion and removing it from the mold assembly.

Casting of ferrous and aluminum alloys are contemplated. However, the present techniques are particularly advantageous for casting ferrous metal alloys. In certain variations, a metal used for casting is a ferrous alloy comprising iron, carbon and silicon, such as gray cast iron. Typical gray cast iron materials comprise greater than or equal to about 2 to less than or equal to about 4% carbon, and greater than or equal to about 1 to less than or equal to about 3% by weight silicon. Inoculants and other additives may be included in such an alloy. Certain alloying elements can be included that promote formation of the desired forms of graphite (Type A graphite flakes) in the cast material matrix, while reducing the tendency to form undesirable species like chill (e.g., white iron or eutectic carbide ($Fe_3C$)).

In addition to the silicon and carbon described above, other non-limiting alloying ingredients that can be included in ferrous alloys at appropriate levels known to those of skill in the art include: copper, tin, chromium, antimony, manganese, strontium, cerium, yttrium, scandium, neodymium, lanthanum, calcium, barium, titanium, zirconium, nickel, molybdenum, titanium, or any combinations thereof. In certain variations, the amount of each respective alloying ingredient is less than or equal to about 1.5% by weight, optionally less than or equal to about 1% by weight, optionally less than or equal to about 0.75% by weight, optionally less than or equal to about 0.5% by weight, optionally less than or equal to about 0.25% by weight, optionally less than or equal to about 0.1% by weight, and in certain variations, optionally less than or equal to about 0.01% by weight. In certain aspects, the ferrous alloy may be substantially free of such alloying ingredients, for example, equal to an impurity level of 0% to less than about 0.001% by weight.

Certain suitable gray cast iron materials optionally comprise greater than or equal to about 2% to less than or equal to about 4% carbon; greater than or equal to about 1% to less than or equal to about 3% by weight silicon; greater than or equal to about 0.2% to less than or equal to about 1% by weight copper; optionally greater than or equal to about 0.025% to less than or equal to about 0.2% by weight tin; optionally greater than or equal to about 0.025% to less than or equal to about 0.2% by weight chromium; optionally greater than or equal to about 0.01% to less than or equal to about 0.2% by weight of antimony and/or strontium of the total composition. Particularly suitable gray iron alloys having various alloying or inoculating ingredients for use in casting scroll components are described in U.S. Pat. No. 5,580,401 and reissued as RE37,520 on Jan. 22, 2002 to Williamson entitled "GRAY CAST IRON SYSTEM FOR SCROLL MACHINES," which is incorporated by reference herein.

In certain aspects, a ferrous alloy comprises carbon at greater than or equal to about 2.5% to less than or equal to about 3.9% by weight of the composition, optionally at about 3.3% by weight of the composition. In certain variations, carbon is present in the alloy at greater than or equal to about 3.25% to less than or equal to about 3.35% by weight of the composition. Silicon is present in the composition in an amount of greater than or equal to about 1.5% to less than or equal to about 3% by weight of the composition. In certain variations, silicon is present in the alloy at greater than or equal to about 2% to less than or equal to about 2.2% by weight of the composition. Manganese is optionally present in the composition in an amount ranging from about 0.3% to about 1% by weight of the composition. Chromium is optionally present in the composition in an amount ranging from about 0.08% to about 0.13% by weight of the composition. Copper is optionally present in the composition in an amount ranging from greater than or equal to about 0.4% to less than or equal to about 0.7% by weight of the composition. Tin is optionally present in the composition in an amount ranging from greater than or equal to about 0.08% to less than or equal to about 0.12% by weight of the composition. Molybdenum if present is provided in an amount less than or equal to about 0.08% of the composition. Phosphorus, if present, is provided in an amount less than or equal to about 0.06% of the composition. The remainder of the alloy comprises iron and one or more impurities collectively present at less than about 0.1% by weight. For example, the ferrous alloy composition that forms a gray cast iron may comprise iron at greater than or equal to about 50% by weight, and more preferably at greater than about 85% by weight of the material) along with carbon, silicon, and manganese in predetermined amounts.

In one suitable embodiment, a metal ferrous alloy comprises carbon (C) at greater than or equal to about 3.25% to less than or equal to about 3.35% by weight of the composition; silicon at greater than or equal to about 2% to less than or equal to about 2.2% by weight of the composition; copper at greater than or equal to about 0.4% to less than or equal to about 0.7% by weight of the composition; tin at greater than or equal to about 0.08% to less than or equal to about 0.12% by weight of the composition; chromium at greater than or equal to about 0.08% to less than or equal to about 0.13% by weight of the composition; phosphorus at less than or equal to about 0.06% by weight of the composition; molybdenum at less than or equal to about 0.08% of the composition; one or more impurities collectively less than about 0.1% by weight of the composition, and a balance of iron (Fe).

In certain variations, an involute vane portion formed by casting in accordance with the present teachings is not made from either a eutectic graphite cast iron or an aluminum alloy, but does contain titanium (a natural impurity in gray iron and/or an additive for nitrogen control) and has a total carbon content of 3.27% by weight nominal (within a range of greater than or equal to about 3.15% by weight to about 3.45% by weight).

It will be appreciated by those of skill in the art that higher or lower amounts of the components may be suitably employed. Trace amounts of certain ingredients may be present in the alloy, for example, sulfur may be present at about 0.15% by weight or less, lead at 0.003% by weight, and aluminum at 0.01% by weight or less. To this, inoculants or other alloying ingredients may be added to promote formation of fine Type A graphite in a pearlite matrix, as taught by U.S. Pat. No. 5,580,401 (RE37,520).

Where gray cast iron is employed, a typical microstructure is a matrix of predominately pearlite ($\alpha$-Fe and $Fe_3C$ phases) with flake graphite dispersed therein. The amount, size and distribution of graphite depend upon nucleation and growth conditions. Flake graphite is typically subdivided into five different categories: Types A-E. In various aspects, Type A graphite flakes are a preferred type of graphite for the involute portions of the cast scroll component. Type A flake graphite has a random orientation, is substantially uniformly distributed in the matrix, and is generally superior for its tribological properties. Type B flake graphite is generally described as having a rosette pattern that tends to occur in conjunction with fairly rapid cooling. Type B graphite is commonly formed in thin cast sections or along surfaces of thicker castings (sometimes resulting from poor inoculation). Type C graphite flakes are large flakes, which are not amenable to good surface finishes on machined parts, high strength, or good impact resistance. Type D graphite includes small, randomly oriented inter-dentritic flakes. Type D graphite is commonly formed in thin cast sections or along surfaces of thicker castings that are rapidly cooled. Type D graphite interferes with formation of a pearlitic matrix and can result in soft spots in the cast component. Type E is similarly an inter-dentritic form of graphite that is not randomly oriented, but rather usually has a predominant orientation. Unlike Type D, Type E can be associated with formation of a pearlitic matrix. However, both Types D and E form in undercooled structures that experience relatively rapid cooling rates and are generally undesirable. These various graphite forms found in cast gray iron are discussed more in depth in American Society for Metals, "METALS HANDBOOK, DESK EDITION," Chapter 5, pp. 5-3 to 5-5 (1992), which is expressly incorporated herein by reference.

In various aspects, a desired cast metal microstructure in the involute portions of the scroll component formed from casting a ferrous alloy (like cast gray iron) in accordance with the present teachings includes a generally uniform dispersion of relatively fine Type A graphite flakes. In accordance with the present disclosure, such Type A graphite flakes are attainable regardless of section thickness in the cast component. Due to the configuration of the gating into the central patterned region of the core, any formation of less desirable graphite species in the involute portion, like dendritic Type B or undercooled Types D and E, are diminished or avoided altogether. If such undesirable graphite species are formed in the scroll component, they are relegated to the baseplate portion, which is of less impact to the scroll component machinability and performance.

In certain aspects, the involute portion is substantially free of Type B graphite, Type C graphite, Type D graphite, and Type E graphite species. In accordance with certain aspects of the present disclosure, involute portions of the solidified cast scroll compressor component are substantially free of undercooling defects. As discussed above, the term "substantially free" means that the graphite species is absent to the extent that that undesirable and/or detrimental effects attendant with its presence are avoided. In certain embodiments, an involute portion that is "substantially free" of Type B graphite, Type C graphite, Type D graphite, and Type E graphite species comprises less than about 5% by weight of the undesired graphite species, more preferably less than about 4% by weight, optionally less than about 3% by weight, optionally less than about 2% by weight, optionally less than about 1% by weight of undesired graphite species, optionally less than about 0.5% and in certain embodiments comprises 0% by weight of the undesired graphite species in the composition.

In certain variations, a cast ferrous alloy forms a matrix of pearlite and graphite, where greater than or equal to about 75% of the graphite in the involute portion of the cast scroll compressor component is a Type A graphite. In certain aspects, greater than or equal to about 85% of the graphite formed in the involute portion of the cast scroll compressor is Type A graphite at the surface; optionally greater than or equal to about 90%; optionally greater than or equal to about 95%; optionally greater than or equal to about 96%; optionally greater than or equal to about 97%; optionally greater than or equal to about 98%; optionally greater than or equal to about 99% of the graphite formed in the involute portion of the cast scroll compressor is advantageously Type A graphite.

Stated in another way, involute portions of scroll components formed in accordance with the present teachings that are substantially free of Types B-E graphite species have greater than or equal to about 95% by weight of Type A graphite species (of all graphite species formed), more preferably greater than or equal to about 96% by weight, optionally greater than or equal to about 97% by weight, optionally greater than or equal to about 98% by weight, optionally greater than or equal to about 99%, and optionally greater than or equal to about 99.5% by weight of Type A graphite species.

Thus, the present teachings provide that the cast materials, especially the involute portions of a scroll component, demonstrate superior strength and fatigue resistance, while also exhibiting good machinability to permit rapid and easy removal of the materials while maximizing as-cast yield, and reducing post-casting finishing inefficiencies.

Figure 8:
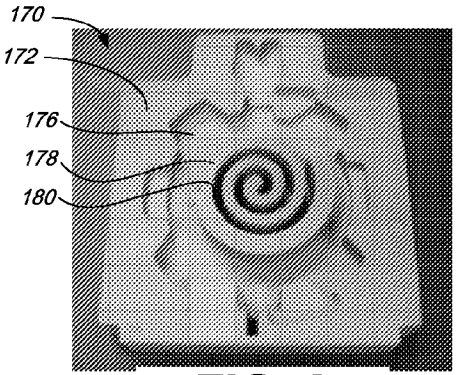
FIGS. 8-9 show perspective views of a core prepared in accordance with certain variations of the present disclosure for use in a casting mold assembly to form a fixed scroll compressor component.
Figure 9:
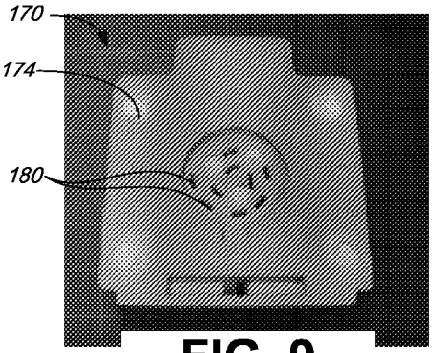
Figure 12:
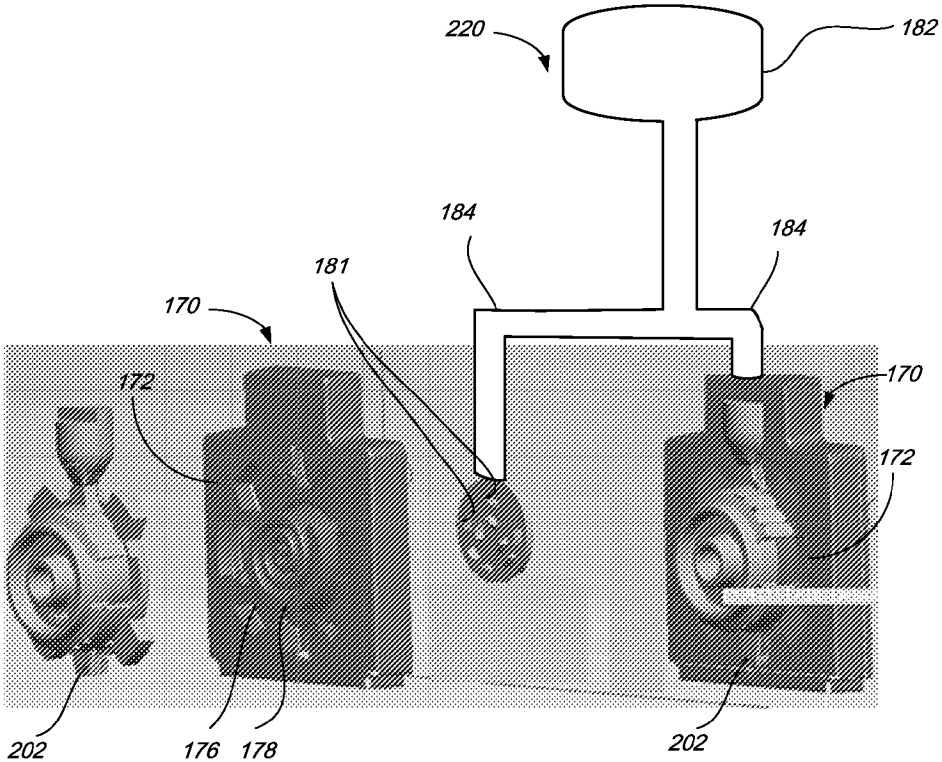
FIG. 12 is an exploded view of a dual molding assembly with solidified cast fixed scroll components after the casting process with a core as shown in FIGS. 8-9.

FIGS. 8-11 show perspective views of casting cores for use in a mold assembly prepared in accordance with certain variations of the present teachings. FIGS. 12-13 show exploded views of dual casting mold assemblies for forming a fixed scroll component and an orbiting scroll component, respectively. FIGS. 8-9 show a core 170 for forming a fixed scroll component 202 of FIG. 12. In FIG. 8, a first side 172 of core 170 is shown that will form the exposed surface facing the molding cavity, which will contact molten metal during casting. A patterned surface 176 of the first side 172 will form a surface design on the cast part. A centrally disposed patterned region 198 defines an involute portion for the cast fixed scroll component 202. Furthermore, a plurality of openings (e.g., gate openings) 180 is formed in the valleys of the centrally disposed patterned region 178 to permit fluid communication into the cavity through core 170. FIG. 9 shows a second side 174 of core 170 that faces the gating system (for example a sprue) and contacts molten metal as it is introduced into the mold assembly. As can be seen, nine gate openings 180 are formed along the centrally disposed patterned region 178 that will form the tips of the cast involute vane. Thus, molten metal passes through the plurality of gate openings 180 and into the cavity of the molding assembly, where it fills the involute shape of the centrally disposed patterned region 178 and then the depressions and surface contours of the patterned surface 176 to form the fixed scroll component.

FIG. 12 shows a casting system 220 with dual molding apparatuses filled from a shared pouring basin and sprue 182 that leads to dual gating systems 184 (shown after a casting process where the metal has solidified to form the cast fixed scroll components). Each respective gating system 184 leads to the casting mold assembly, including respective fixed scroll component cores 170. One cast part 202 has been removed from the core 170 to expose a surface of the core's first side 172 (opposite surface of second side 174 is not visible from this perspective). While the gates are not visible in the core 170 in FIG. 12, the metal nubs 181 that filled the nine gates formed through the involute portion of the centrally disposed region 178 of the core 170 are shown.

FIGS. 10-11 likewise show a core 190 for forming an orbiting scroll component 204 of FIG. 13. In FIG. 10, a first side 192 of core 190 is shown that will form the exposed surface facing the molding cavity, which will contact molten metal during casting. In FIG. 11, the opposite second side 194 of core 190 is shown that faces the gating system (for example a sprue) and contacts molten metal to permit fluid communication through the core 190. A patterned surface 196 of the first side 192 will form a surface design on the orbiting scroll component. A centrally disposed patterned region 198 defines an involute portion for the orbiting scroll component 204. Furthermore, a plurality of openings (e.g., gate openings) 200 is formed in the valleys of the centrally disposed patterned region 198 to permit fluid communication into the cavity through core 190.

As can be seen, ten gate openings 200 are formed along the centrally disposed patterned region 198 that will form the tips of the cast involute vane. Thus, molten metal passes through the plurality of gate openings 200 and into the cavity of the molding assembly, where it fills the involute shape of the centrally disposed patterned region 198 and then the depressions and surface contours of the overall patterned surface 196 to form the fixed scroll component (in cooperation with the molds).

FIG. 13 shows a casting system 230 with dual molding apparatuses filled from a shared pouring basin and sprue 212 that leads to dual gating systems 214 (shown after a casting process where the metal has solidified to form the cast fixed scroll components). Each respective gating system 214 leads to the casting mold assembly, including respective orbiting scroll component cores 190. One cast part 204 has been removed from the core 190 to expose the core's first surface 192 (opposite surface 194 is not visible from this perspective). While the gates are not visible in the core 190 in FIG. 13, the metal nubs 201 that filled the ten gates formed through the involute portion of the centrally disposed region 198 of the core 190 are shown. Formation of cores in accordance with various aspects of the present disclosure can require significantly more complex formation processing with longer processing times and more extensive patterning; however, advantageously such cores improve scroll component quality, especially in the defect and failure susceptible involute portions of both fixed and orbiting scroll components. Furthermore, various aspects of the present teachings can be employed with a variety of casting methods to form improved scroll components having high quality involute portions.

In various aspects, comparative evaluation of scroll components formed in accordance with conventional casting techniques are compared to those formed in accordance with certain principles of the present inventive technology (involving casting by gating through an involute portion of a core). For example, a DISAMATIC™ sand mold casting process is used to compare cast iron scroll components. Fatigues strengths at a discharge end of an involute vane in both a fixed scroll component and an orbiting scroll component, cast in accordance with the present teachings via a DISAMATIC™ casting process where gating occurs through the involute portions, are compared to those formed with the same materials, but in a conventional shell-molding casting process.

In one example, fatigue strength of the discharge end of the orbiting scroll involute portion vane is evaluated by applying a load normal to the inner involute surface at a distance about 0.25 inch from an end of the involute vane tip (see 26 and 36 in FIGS. 1 and 3). The orientation of the point load is determined using finite element analysis (FEA) to simulate peak stress at the base of the involute vane tip caused by pressure differential between a discharge pocket and a lead pocket. The fatigue lives of the discharge vane in the inventive examples and conventional cast iron orbiting scrolls are determined via a Weibull plot. A total of 16 orbiting scroll components formed in accordance with certain aspects of the principles of the present teachings (made via the DISAMATIC™ casting process) and conventional castings are evaluated. Nine of these scrolls failed with times to failure between 1,601K and 2,955K cycles while the remaining 7 scrolls reached 4M cycles without failing. The discharge involute portion vane fatigue strength of the orbiting scroll components formed in accordance with the principles of the present teachings is at least 18 percent higher than that of conventional production shell mold orbiting scrolls formed via a conventional process, based on an elastic fatigue strength exponent of −0.07 for cast iron. The fatigue strength of the discharge vane in the fixed scroll components is evaluated using the same procedure as for the orbiting scrolls. Two different embodiments of fixed scroll components formed in accordance with the principles of the present disclosure are comparatively tested with conventional cast fixed scroll components, one with very high hardness and one with nominal hardness. The fatigue lives of the nominal and high hardness Steelhead fixed scrolls are determined via Weibull plots. The discharge vane of the involute portion in the inventive fixed scroll component with nominal hardness has between 1,436K and 4,873K cycles times to failure. The times to failure for the discharge vane of the involute portion in inventive fixed scroll components with very high hardness are between 1,512K and 4,869K cycles. Therefore, the fatigue lives of two embodiments prepared in accordance with the inventive technology (fixed scrolls with nominal and alternatively very high hardness) are statistically the same. Furthermore, the fatigue strength of the discharge vane of the involute portion is found to be at least 24 percent higher than that of conventional shell mold production fixed scrolls.

Therefore, in certain variations, fatigue strength of an orbiting scroll component involute discharge vane formed in accordance with certain principles of the present teachings is at least 18% higher than that of a conventional shell molded orbiting scroll component. Likewise, in certain variations, fatigue strength of a fixed scroll component involute discharge vane prepared in accordance with certain principles of the present teachings is at least 24% higher than that of a conventional shell molded fixed scroll component. In certain aspects, an involute portion of a cast solid scroll compressor component after solidification formed in accordance with certain principles of the present teachings has a fatigue strength that is greater than or equal to about 18% higher than a comparative cast scroll compressor component. The comparative cast scroll component is cast in a process where the core lacks any gate openings in the patterned region, so that molten metal does not pass through gate openings in a patterned region of a comparative core. In other aspects, an involute portion of a cast solid scroll compressor formed in accordance with certain principles of the present teachings after solidification has a fatigue strength that is greater than or equal to about 20%, optionally greater than or equal to about 22%, optionally greater than or equal to 24% higher than a comparative cast scroll compressor component.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of casting a scroll compressor component, the method comprising:

introducing a molten metal into a casting mold assembly comprising a mold and a core, wherein the core has a central patterned region comprising one or more gate openings that extend through the core, wherein the mold and the core together define a cavity having a shape of the scroll compressor component comprising an involute portion defined by the central patterned region of the core, wherein the molten metal is introduced to the cavity through the one or more gate openings in the involute portion of the central patterned region of the core;

solidifying the molten metal to form a solid scroll compressor component comprising the involute portion; and removing the solid scroll compressor component from the casting mold assembly.

2. The method of claim 1, wherein the molten metal is a ferrous alloy composition comprising carbon (C) at greater than or equal to about 3.25% to less than or equal to about 3.35% by weight of the composition; silicon (Si) at greater than or equal to about 2% to less than or equal to about 2.2% by weight of the composition; copper (Cu) at greater than or equal to about 0.4% to less than or equal to about 0.7% by weight of the composition; tin (Sn) at greater than or equal to about 0.08% to less than or equal to about 0.12% by weight of the composition; chromium (Cr) at greater than or equal to about 0.08% to less than or equal to about 0.13% by weight of the composition; phosphorus (P) at less than or equal to about 0.06% by weight of the composition; molybdenum (Mo) at less than or equal to about 0.08% by weight of the composition; one or more impurities collectively present at less than about 0.1% by weight of the composition; and a balance of iron (Fe).

3. The method of claim 2, wherein the ferrous alloy forms a matrix of pearlite and graphite and greater than or equal to about 75% of graphite along a surface of the involute portion of the cast solid scroll compressor component is a Type A graphite.

4. The method of claim 1, wherein the core comprises at least nine gate openings that extend through the central patterned region and the solid scroll compressor component is a fixed scroll component.

5. The method of claim 1, wherein the core comprises at least ten gate openings that extend through the central patterned region and the solid scroll compressor component is an orbiting scroll component.

6. The method of claim 1, wherein the one or more gate openings are tapered from a first surface of the core to a second surface of the core and have a shape selected from the group consisting of: a tapered cylinder, a pyramid, and a tapered cube.

7. The method of claim 1, wherein the method further comprises machining the involute portion of the solid scroll compressor component after the removing.

8. The method of claim 1, wherein the shape of the scroll compressor component defined by the cavity further comprises a baseplate portion and one or more side gates, so that when the molten metal is introduced to the cavity, it concurrently flows through the one or more gate openings in the central patterned region of the core and through the one or more side gates.

9. The method of claim 1, wherein the involute portion of the solid scroll compressor component after the solidifying has a fatigue strength that is greater than or equal to about 18% higher than an involute portion of a comparative cast scroll compressor component cast in a comparative process where molten metal does not pass through gate openings in a central patterned region of a comparative core.

10. The method of claim 1, wherein the involute portion of the solid scroll compressor component after the solidifying has a fatigue strength that is greater than or equal to about 24% higher than an involute portion of a comparative cast scroll compressor component cast in a comparative process where molten metal does not pass through gate openings in a central patterned region of a comparative core.

11. The method of claim 1, wherein during the introducing of the molten metal until the solidifying, the involute portion of the solid scroll compressor component is maintained at a temperature such that the involute portion is substantially free of undercooling defects.

12. The method of claim 1, wherein the method of casting is selected from a group of processes consisting of: green sand casting, shell molding casting, lost foam casting, and vertically molded sand casting.

13. A method of casting a scroll compressor component, the method comprising:

introducing a molten metal comprising iron into a casting mold assembly comprising a mold and a core, wherein the core has a central patterned region comprising a plurality of gate openings that extend through the core, wherein the mold and the core together define a cavity having a shape of the scroll compressor component comprising an involute portion defined by the central patterned region of the core, wherein the molten metal is introduced to the cavity through one or more of the plurality of the gate openings in the involute portion of the central patterned region of the core;

solidifying the molten metal comprising iron to form a solid scroll compressor component comprising the involute portion; and removing the solid scroll compressor component from the casting mold assembly, wherein the involute portion comprises a matrix of pearlite and Type A graphite and the involute portion is substantially free of undercooling defects.

14. The method of claim 13, wherein the involute portion is substantially free of Type B graphite, Type C graphite, Type D graphite, and Type E graphite species.

15. The method of claim 13, wherein the metal comprising iron comprises carbon (C) at greater than or equal to about 3.25% to less than or equal to about 3.35% by weight of the composition; silicon (Si) at greater than or equal to about 2% to less than or equal to about 2.2% by weight of the composition; copper (Cu) at greater than or equal to about 0.4% to less than or equal to about 0.7% by weight of the composition; tin (Sn) at greater than or equal to about 0.08% to less than or equal to about 0.12% by weight of the composition; chromium (Cr) at greater than or equal to about 0.08% to less than or equal to about 0.13% by weight of the composition; phosphorus (P) at less than or equal to about 0.06% by weight of the composition; molybdenum (Mo) at less than or equal to about 0.08% by weight of the composition; one or more impurities collectively present at less than about 0.1% by weight of the composition; and a balance of iron (Fe).

16. The method of claim 13, wherein greater than or equal to about 95% of graphite along a surface of the involute portion of the solid scroll compressor component is a Type A graphite.

17. The method of claim 13, wherein the involute portion of the solid scroll compressor component after the solidifying has a fatigue strength that is greater than or equal to about 18% higher than in a comparative cast scroll compressor component that is cast in a comparative process where molten metal does not pass through gate openings in a central patterned region of a comparative core.

18. A method of casting a scroll compressor component, the method comprising:

introducing a molten metal into a casting mold assembly defining a cavity having a shape of the scroll compressor component comprising an involute portion, wherein the casting mold assembly further comprises a mold comprising a central patterned region that defines the involute portion and comprises one or more gate openings that extend through the mold in the central patterned region, wherein the molten metal is introduced to the cavity through the one or more gate openings in the involute portion of the central patterned region of the mold; and solidifying the molten metal to form a solid scroll compressor component comprising the involute portion and removing it from the casting mold assembly.

19. The method of claim 18, wherein the involute portion of the solid scroll compressor component is substantially free of Type B graphite, Type C graphite, Type D graphite, or Type E graphite species.

20. The method of claim 18, wherein the molten metal is a ferrous alloy that forms a matrix of pearlite and graphite and greater than or equal to about 75% of graphite along a surface of the involute portion of the cast solid scroll compressor component is a Type A graphite.

* * * * *